United States Patent [19]

Landfors

[11] 4,108,576

[45] Aug. 22, 1978

[54] LOW COST, THERMALLY EFFICIENT DIFFUSION PUMP

[75] Inventor: Arthur A. Landfors, Sharon, Mass.

[73] Assignee: Varian Associates, Inc., Palo Alto, Calif.

[21] Appl. No.: 702,653

[22] Filed: Jul. 6, 1976

[51] Int. Cl.[2] ..... F04F 9/00

[52] U.S. Cl. ..... 417/153; 417/154

[58] Field of Search ..... 417/51, 87, 152-154

[56] References Cited

U.S. PATENT DOCUMENTS

| | | | |
|---|---|---|---|
| 2,063,665 | 12/1936 | Edwards | 417/154 X |
| 2,379,152 | 6/1945 | Hickman | 417/154 |
| 2,386,299 | 10/1945 | Downing | 417/154 |
| 2,397,591 | 4/1946 | Becker | 417/154 |
| 2,840,297 | 6/1958 | Hickman | 417/154 |
| 2,943,783 | 7/1960 | Bancroft et al. | 417/154 |
| 3,141,606 | 7/1964 | Landfors | 417/154 |
| 3,572,973 | 3/1971 | LeBlanc | 417/154 |
| 3,697,195 | 10/1972 | Johnson et al. | 417/154 |

FOREIGN PATENT DOCUMENTS

| | | | |
|---|---|---|---|
| 596,964 | 1/1948 | United Kingdom | 417/153 |

*Primary Examiner*—William L. Freeh
*Assistant Examiner*—Edward Look
*Attorney, Agent, or Firm*—Stanley Z. Cole; Leon F. Herbert; Edward H. Berkowitz

[57] ABSTRACT

A vacuum diffusion pump includes a body assembly fabricated from a single piece of deep drawn sheet metal whereby a cylindrical wall of the body assembly, a flange for connecting the diffusion pump to a vacuum chamber, and a floor for a pool of diffusion pump fluid are all formed from the single piece of sheet metal. A boiler for heating the fluid to a vapor includes a cylindrical heating surface centrally located in the pool and extending axially from the bottom surface of the pool. The heating surface is surrounded by a separator tube having openings close to the bottom of the pool so that liquid in the pool enters an annular space between the separator and heating surface close to the bottom of the pool and rises in the annular space while being heated to vaporization. A solid heat insulator is located in another annular space between a cup and the exterior of a segment of the body wall that confines the pool and the exterior of the floor. A cooling coil is wrapped with an uneven pitch around the exterior of a cool wall portion of the body assembly so that the coil is in contact with the hottest parts of the wall portion and cooler parts of the wall portion are not in contact with the coil. A flange clamping plate surrounds the flange to clamp it against the chamber being evacuated. A baffle plate, positioned between a first stage of the pump and the flange, is mechanically connected to the cool wall portion through a path having a high thermal conductivity so that the baffle is cool enough to condense vapor of the diffusion pump fluid that impinges on it.

22 Claims, 3 Drawing Figures

LOW COST, THERMALLY EFFICIENT DIFFUSION PUMP

FIELD OF INVENTION

The present invention relates generally to diffusion pumps and more particularly to a diffusion pump having a body assembly, including (1) a cool wall portion, (2) a wall segment defining the periphery of a pool of diffusion pump fluid, (3) a flange for connecting the pump to a vacuum chamber being evacuated, and (4) a floor for the pool, formed from a single piece of deep drawn sheet metal.

BACKGROUND OF THE INVENTION

Relatively small vacuum diffusion pumps designed to evacuate a chamber to a vacuum of $10^{-7}$ torr, or to a greater vacuum, have typically been relatively high priced items, particularly if they have been designed to have good speed characteristics and high fore-pressure tolerances, on the order of 0.5 torr. A typical prior art diffusion pump is illustrated in FIG. 1 and includes a cylindrical body assembly 11, having a longitudinal axis 12. Body assembly 11 includes a cylindrical shell 13, coaxial with axis 12, fabricated from roll-up or standard tubing cut to size. At the bottom of shell 13, a pool 14 of vaporizable diffusion pump fuild or oil is provided. The peripheral wall of pool 14 is formed by the bottom of shell 13, while the floor of the pool is defined by an annular, machined metal plate 15 that is bonded, usually by welding, to the bottom edge of shell 13. In one configuration, the liquid in pool 14 is heated to vaporization by an electric resistance heater 16 that is inserted in tubular, sheet metal thimble 17. A protective cup 18 extends downwardly from plate 15 and includes a connector 19 to which leads for heater 16 are connected to an external power source. In certain configurations, axially extending heater 16 and thimble 17 are replaced with a heater assembly mounted below machined metal plate 15.

The diffusion pump is sealingly connected through an opening to baffle assembly 71 and vacuum chamber 21. To this end, the top of shell 13 is welded to machined metal flange plate 22 that is concentric with axis 12 and includes an annular groove in which sealing O-ring 23 is placed. Flange plate 22 has a plurality of bores which mate with corresponding bores in a flange of baffle assembly 71; bolts 24 are inserted in the matching bores to sealingly connect the diffusion pump to baffle assembly 71 which, in turn, is connected to chamber 21 through a flange and seal arrangement similar to that described for the connection between the pump and baffle assembly.

Within body assembly 11 a jet assembly (not shown in FIG. 1) is provided; the jet assembly is made by spinning or from machined castings and includes at least one, and usually several, annular diffusion pump nozzles for directing vapor evaporated from pool 14 downwardly against shell 13. The diffusion pump fluid contacting shell 13 is condensed since the shell is cooled by a cooling coil 25 having a uniform pitch along the portion of shell 13 just below flange 22 to a region just above radially extending conduit 26 that forms a portion of fore line 27 that is connected to a fore line pump (not shown). Conduit 26 is positioned opposite from a horizontally directed ejector stage nozzle (not shown in FIG. 1).

To prevent migration of diffusion pump vapors from the diffusion pump into vacuum chamber 21, a baffle assembly 71 is usually inserted just above flange 22 and below flange 73 that connects the baffle assembly to chamber 21. Assembly 71 includes blocking plate 74 that is mounted on cooling coil 75 in a horizontal plane at right angles to axis 12 to prevent axial flow of vapor between the pump and chamber.

From a review of FIG. 1, it becomes apparent that the prior art device is relatively expensive to build and operate. In particular, numerous operations are required to assemble body assembly 11, in that it is necessary to machine the plates forming pool bottom 15 and flange 22 and to then weld these plates completely around their peripheries to form seals with the top and bottom edges of shell 13.

In addition, the typical prior art design of cooling coils 25, so that the coil has a uniform pitch, results in a substantial cost factor, insofar as materials of the cooling coil and the cost of installation are concerned. The typical prior art design has also tended to cause more cooling than is necessary so that the diffusion pump fluid has a tendency to be excessively cool when it reaches pool 14. Excessive cooling of the diffusion pump fluid, when it reaches pool 14, increases the cost required to operate heater 16, in addition to the cost of energy required to operate coil 25.

The typical, previously utilized baffle also adds to the expense of the unit by increasing material and labor costs. In addition, fabricating the jet assembly from spinning or machine castings has a tendency to increase costs, particularly if high production is expected.

BRIEF DESCRIPTION OF THE INVENTION

In accordance with the present invention, there is provided a relatively small diffusion pump that can be mass produced inexpensively in large quantities, so that it has good speed and high fore-pressure tolerance, and can be operated efficiently with a minimum amount of energy. An important characteristic of the improved diffusion pump is that the entire body assembly, including a cool wall portion, a wall segment that defines the periphery of the pool, the flange for connection to the load, and the pool floor, is formed from a single piece of sheet metal. The sheet metal is deep drawn to form the flange and floor from the shell, as well as to provide rounded corners between the wall segment and pool bottom, as well as between the cool wall portion and the flange. While there are prior art patents which illustrate diffusion pumps wherein the body assembly appears to be fabricated from a single piece of sheet metal, it is noted that these showings are schematic and do not attempt to illustrate correctly the actual configuration of the pump. To my knowledge, there are no prior art devices wherein the entire body assembly, including the cool wall portion, the wall segment forming the pool periphery, the flange and the floor of the pool, is formed from a single sheet of sheet metal.

The operating costs of a diffusion pump in accordance with the present invention are also substantially reduced over the typical prior art device by wrapping a cooling coil around the exterior of the cooled wall portion of the body assembly, whereby the coil has a non-uniform pitch so that the coil is in contact with the hottest parts of the wall portion and cooler parts of the wall portion are not in contact with the coil. By specially designing the coil in this manner, the amount of coil material is reduced and the hottest parts of the body assembly, where maximum cooling is necessary, are cooled without cooling the other parts of the body assembly. The liquid remains at a relatively high temperature while it is flowing along the wall of the body assembly back to the pool. Thereby, the amount of energy that must be applied to the heater and the pool is reduced over the prior art configuration.

The heat energy applied to the pool is also reduced by providing an improved thermal insulator about the exterior of the body assembly defining the periphery of the pool, i.e., the wall segment and the floor of the pool. The improved thermal insulator is a solid, refractory felt material, perferably formed of a ceramic fiberglas material known as Cerafelt. The refractory material is inserted in a space between the wall segment and pool floor and a cup surrounding the bottom portions of the body assembly.

To provide the desired seal between the pump and the evacuated chamber, a flange clamping plate, including apertures through which the bolts are inserted, surrounds an unapertured flange to clamp the flange against the chamber. The plate has a contact face pressing against one side of an annular ear of the flange, in which an O-ring is inserted to form a seal between the flange and the chamber. This construction prevents bending of the flange and enables the pump to be easily connected between the chamber and fore pump since the plate is rotatable relative to the flange.

The desired results of the present invention are achieved with the assistance of a baffle plate that is positioned between a first stage of the pump and the opening between the pump and the vacuum chamber being evacuated. The baffle plate is formed as an integral part of the pump and rests on a shoulder of the body, just below the flange and the opening to the vacuum chamber. The resulting mechanical connection between the body assembly and the baffle plate provides a path having a high thermal conductivity between the cool wall portion of the body assembly and the baffle plate so that any vapor of the diffusion pump fluid that impinges on the baffle plate is condensed and can easily flow, by gravity, back to the pool.

To assist in minimizing costs, the jet assembly has been designed so that the parts can be readily stamped, in contrast to the prior art, where the jet assemblies have been spun or machined castings. In addition, the jet assembly has been designed so that the pump is able to handle a fore-pressure tolerance of 0.5 torr, even though the total power consumption of the pump is only 300 watts, which represents a reduction of one-third to two-thirds over the prior art devices. The high fore-pressure tolerance and reduced power requirements are achieved by sacrificing throughput since the throat diameter of a second stage of the jet assembly has been designed to be 0.35 inches, instead of the typical prior art 0.070 inches. By decreasing the second stage throat diameter, there is an increase in vapor density of the ejector stage, with the resulting high fore-pressure tolerance.

It is, accordingly, an object of the present invention to provide a new and improved diffusion pump.

Another object of the invention is to provide a new and improved, relatively low cost diffusion pump that is particularly adapted to be mass produced.

A further object of the invention is to provide a new and improved diffusion pump having low cost manufacturing and operating characteristics.

Still another object of the invention is to provide a new and improved diffusion pump having good speed characteristics and high fore-pressure tolerance, yet can be manufactured and operated inexpensively, with a relatively low amount of input power required.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 2:
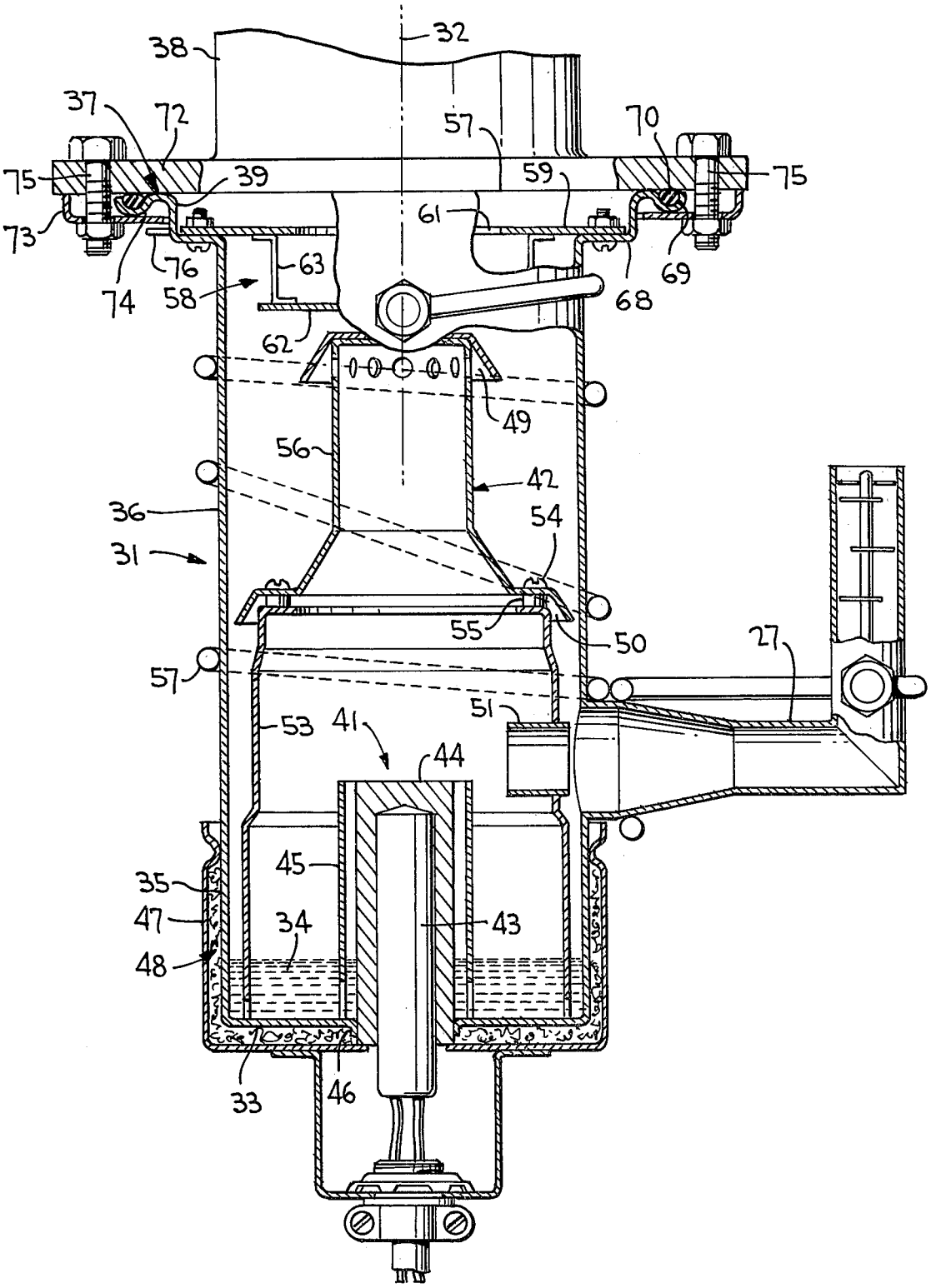
FIG. 2 is a side view of an improved diffusion pump in accordance with the present invention.

Reference is now made to FIG. 2 of the drawing wherein there is illustrated an improved diffusion pump in accordance with the present invention. The improved diffusion pump includes a body assembly 31 having a generally cylindrical configuration with a longitudinal axis 32. Body assembly 31 includes a floor 33 for a pool 34 of liquid diffusion pump fluid of a type that is easily vaporized and is usually formed of an appropriate oil. The vertically extending periphery of pool 34 is surrounded by a wall segment 35, coaxial with axis 32, and which is part of body assembly 31. Cool wall portion 36, also a part of body assembly 31, is an extension of wall segment 35 so that the wall portion and wall segment together form a cylindrical sleeve, i.e., wall segment 35 and wall portion 36 are coaxial and have the same radius. Above wall portion 36 is an unperforated flange 37 that enables the diffusion pump of the present invention to be sealingly connected through an opening to vacuum 38 that is to be evacuated by the diffusion pump of the present invention.

The entire body assembly 31, including floor 33, wall segment 35, wall portion 36, and flange 37 is formed from a single piece of one-sixteenth inch stainless steel metal stock that is deep drawn several times. The deep drawing process causes floor 33 and flange 37 to be formed from the same sheet metal stock as the remainder of the cylindrical body assembly 31. The deep drawing process results in rounded corners being formed between floor 33 and wall segment 35, as well as between wall portion 36 and flange 37. The transition from wall portion 36 to flange 37 is via outwardly extending shoulder 38 and axially extending, short leg segment 39. Shoulder 38 and leg segment 39 are also an integral part of body assembly 31 and have rounded corners with each other and the remainder of the body assembly, a result of the deep drawing process.

The liquid in pool 34 is heated to vaporization by boiler 41 that is centrally located in pool 34 so that liquid in the center of the pool is heated to vaporization and propagates axially of the pump toward nozzles of jet assembly 42. Heater 41 comprises a cylindrical electric heating element 43 extending axially into a reamed bore of metal cylindrical block 44. Block 44 is formed so that it has a relatively thick wall on the order of three-sixteenths of an inch, and is machined from stainless steel so that expired heaters can be removed; element 43 contacts the interior of the heater wall. Heating occurs primarily in an annular region defined by the exterior wall of block 44 and the interior of axially extending sheet metal sleeve 45, having openings in the bottom thereof, i.e., at the bottom or close to the bottom of pool 34, so that liquid from the pool enters into the annular space and rises as it is being heated to vaporization. To facilitate connection of heater 41 to body assembly 31, the body assembly includes, as an integral part thereof, annular flange 46 that depends downwardly from bottom 33 and is welded to the periphery of block 44. Since flange 46 is formed during the deep drawing process in the formation of body assembly 31, there is a rounded corner between bottom 33 and flange 46. The integral body assembly 31 minimizes the amount of welding to other parts, and simplifies the construction, as well as cost, of the entire body assembly.

To reduce the heat loss from the pool 34, wall segment 35 and pool bottom 33 are surrounded by metal cup 47 that is spot welded to the exterior of wall segment 35 and the bottom edge of block 44. The minimize heat transfer from pool 34 and reduce energy requirement, a space formed between the exterior of wall segment 35, as well as the exterior of floor 35, and the interior of cup 47, is filled with a mass of solid refractory felt thermal insulation. The felt insulation is preferably a ceramic fiberglas material, commercially known as Cerafelt.

The diffusion pump liquid heated by boiler 41 to vaporization propagates to a stamped, sheet metal jet assembly 42 including first and second diffusion pump stages 49 and 50, as well as an ejector stage 51. Jet assembly 42 includes a cylindrical-like base segment 53, that rests on pool floor 33. The bottom edge of section 53 includes apertures through which liquid at the bottom of pool 34 flows radially, by convention, toward boiler assembly 41. Base segment 53 is fixedly connected by screws 54 and spacers 55 to upper portion 56 of the jet assembly. Spacers 55 result in the second stage 50 having a nozzle aperture of 0.035 inches, to enable the diffusion pump of the present invention to tolerate variations in the pressure of fore line 27 of 0.5 torr, at a sacrifice in throughput.

The vapor flowing out of the nozzles comprising stages 49 and 50 impinges against cool wall portion 36 of body assembly 31. The vapor is condensed when it impinges against the cool wall portion, and the condensed vapor flows by gravity back to pool 34. Wall portion 36 is cooled in an optimum manner by coil 57 that is non-uniformly wrapped around the exterior of the cool wall portion. Coil 57 has a non-uniform pitch so that the coil is in contact with the hottest parts of wall portion 36 and cooler parts of the wall portion are generally not in contact with the coil. In addition, the liquid flowing along wall portion 36 remains relatively hot so that minimum heat energy is applied to the liquid in pool 34 to cause vaporization.

Positioned between first stage 49 and opening 57 through flange 37 into chamber 38 is a baffle assembly 58 that prevents the direct axial flow of vapor between chamber 38 and nozzle stage 49. If any diffusion pump fluid migrates toward vaccum chamber 38, it is condensed by the cool surface of the elements in the baffle assembly. Baffle assembly 58 includes a metal annular plate 59 having a peripheral portion that rests against the inside of shoulder 68, to which it is fixedly secured. Plate 59 has a single aperture defined by a central, circular opening 61 that is concentric with axis 32 and through which gas pumped from vacuum chamber 38 flows axially. Positioned beneath opening 61 is a circular metal plate or disc 62 that is concentric with axis 32 and connected to plate 59 by metal bolts 63 that depend downwardly from the plate 59. Disc 62 has no perforations therein and a radius greater than the radius of opening 61 so that there is no axial flow of gas past disc 62 and the gas pumped from chamber 38 must flow with a radial outward component past disc 62. Disc 62 is mechanically connected to cool wall portion 36 through a high thermal conductivity path defined by struts 63 and plate 59 so that plates 59 and 62 are both cool enough to condense vapor of the diffusion pump fluid that impinges on them.

Figure 1:
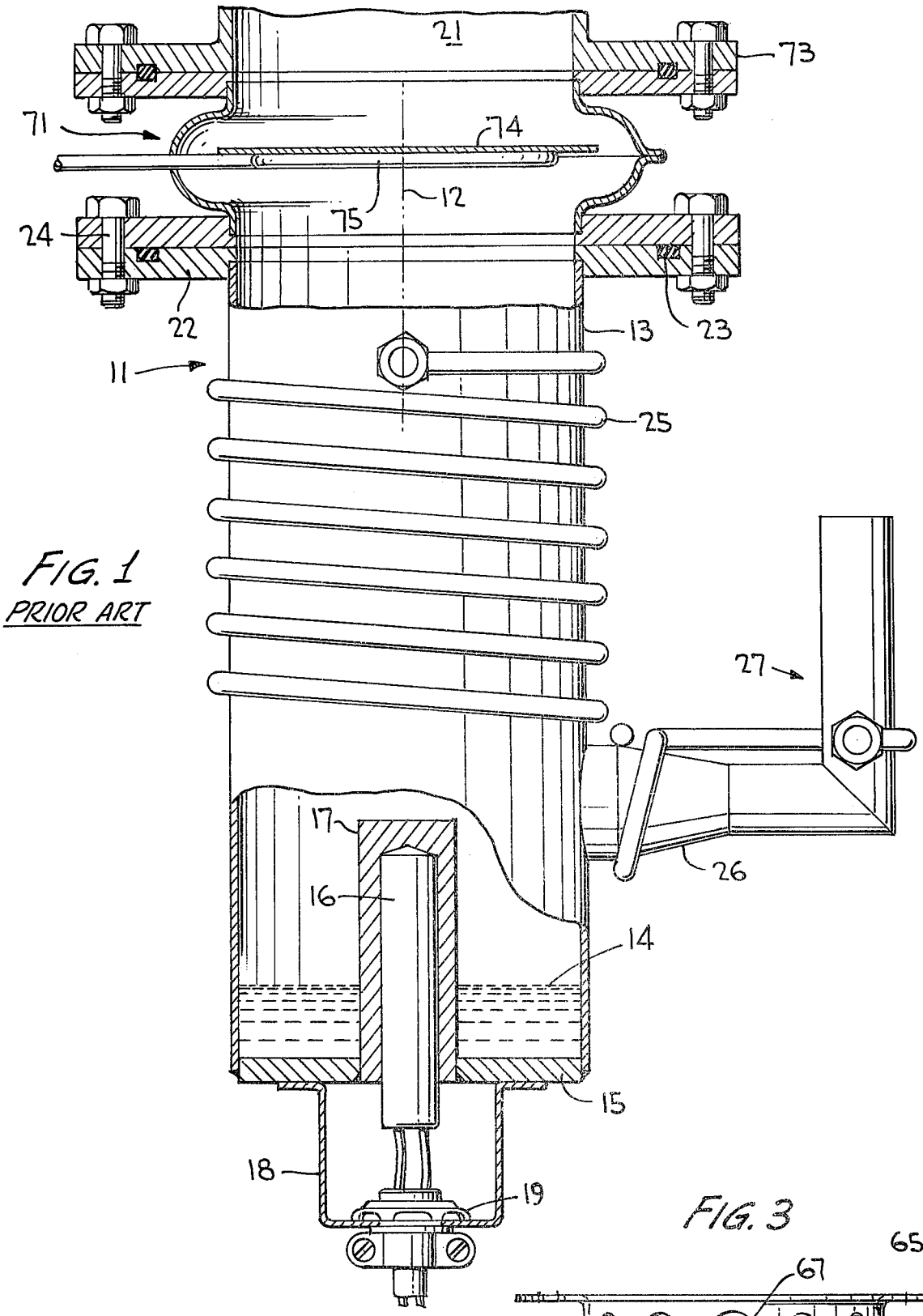
FIG. 1 PRIOR ART
FIG. 1 is a side view of a typical prior art diffusion pump, as discussed supra.
Figure 3:
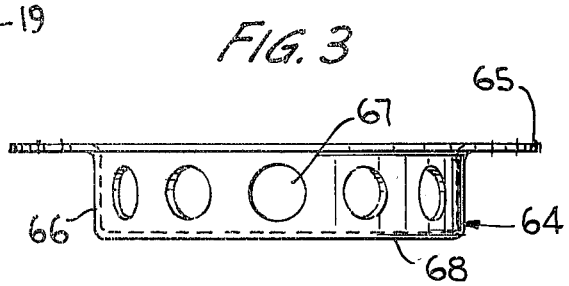
FIG. 3 is a side view of an alternate design of a baffle that can be utilized in the diffusion pump of FIG. 2.

An alternate design for the baffle is illustrated in FIG. 3 and includes a cup 64 formed of a metal having a high thermal conductivity, e.g., copper or aluminum. Cup 64 depends downwardly from plate 65 having a lower, outer edge that rests on the interior of shoulder 68. Plate 65 has a central aperture defined by a circular opening that is concentric with axis 32, whereby gas from chamber 38 flows axially through the opening into cup 64. Cup 64 has a vertically extending sidewall 66 including circular apertures 67 and an unperforated bottom 68. Thereby, gas pumped from chamber 38 flows with a substantial radially directed outward component through the baffle. The baffle of FIG. 3 is an integral, metal structure so that all of the baffle is maintained at a relatively cool temperature and any vapor of the diffusion pump liquid that impinges on the baffle is condensed, and cannot reach opening 81.

Flange 37 includes an annular ear 69 in which O-ring 70 sits to form a seal between flange 72 of vacuum chamber 38 and flange 37 of the diffusion pump. To secure flanges 37 and 72 together, there is provided an annular flange clamping plate 73 that is concentric with axis 32. Plate 73 includes a contact face 74 that bears against the side of ear 69 opposite from O-ring 70 to force the O-ring into sealing engagement between ear 69 and flange 72. Clamping plate 73 is maintained in situ to provide the sealing action by bolts 75 that extend through mating apertures in flange 72 and clamping plate 73. To capture clamping plate 73 against flange 37, so the plate cannot fall against other parts of body assembly when the pump is not in use, three outwardly extending fingers 76 are fixedly secured at equi-spaced distances to leg 39 of body assembly 31; only one of the three fingers is illustrated in FIG. 2.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A diffusion pump for connection between a high vacuum chamber and a fore line leading to a fore pump comprising a body assembly including a cool cylindrical wall portion having a longitudinal centrally located axis, a pool of diffusion pump fluid at the bottom of the body assembly, a boiler for heating the fluid to a vapor state, a jet assembly concentric with the axis, a flow path for the vapor from the surface of the pool to the jet assembly, each jet assembly including at least one annular nozzle concentric with the axis for directing the vapor downwardly and outwardly against the cool wall portion, the cool wall portion condensing the vapor striking it into a liquid that flows downwardly along the cool wall toward the pool, an annular flange concentric with the axis and at the top of the body assembly for enabling the pump to be sealingly connected to the high vacuum chamber, a floor for confining the bottom of the pool, the body assembly having a wall segment for confining the periphery of the pool, a centrally disposed heating surface, the improvement being that the entire body assembly, including the cool wall portion, the wall segment, the flange and the floor are formed from a single piece of sheet metal deep drawn to: (1) have rounded corners between the wall segment and pool bottom as well as between the cool wall portion and the flange, (2) form the flange and floor, (3) form a downwardly depending annular flange connected to the floor by a rounded corner, the downwardly depending flange being formed by deep drawing the body assembly, the downwardly depending flange being bonded to the heating surface, said boiler including a cylindrical heating surface centrally located in the pool and extending axially from the bottom of the pool to the surface of the pool, said surface being surrounded by a separator tube having openings close to the bottom of the pool so that liquid at the bottom of the pool enters an annular space between the separator and the heating surface close to the bottom of the pool and rises in the annular space while being heated to vaporization.

2. The pump of claim 1 wherein the heating surface comprises a cylinder having a reamed cylindrical, axial bore, whereby the heating surface is the exterior of a relatively thick wall, and a cylindrical electric heater positioned in the bore and contacting the interior of the thick wall.

3. The pump of claim 2 further comprising a cup surrounding the wall segment and floor so that a space is formed between the inner surface of the cup and the exterior of the wall segment and floor, the cup being bonded to the wall segment and the cylinder forming the heating surface, a solid heat insulator being located in the space.

4. The pump of claim 1 further comprising a solid heat insulator surrounding the floor and wall segment.

5. The pump of claim 1 wherein the wall portion is cooled by a cooling coil wrapped around the exterior of the wall portion, the coil having a non-uniform pitch contacting parts of the wall portion substantially adjacent each said nozzle and said coil having minimal contact with the wall portion away from the vicinity of each said nozzle.

6. The pump of claim 1 further including a flange clamping plate coaxial with and surrounding the flange to clamp the flange against the chamber.

7. The pump of claim 6, said clamping plate having a contact face pressing against one side of an annular ear of the flange, an O-ring adapted to be in sealing engagement with the other side of the annular ring and the chamber.

8. The pump of claim 1 further including a baffle plate positioned between a first stage of the pump and an intersection between the pump to the chamber, said plate being mechanically connected to the cool wall portion through a path having a high thermal conductivity so that the baffle is cool enough to condense vapor of the diffusion pump fluid that impinges on it.

9. The pump of claim 8 wherein the path includes a centrally apertured plate having a periphery that sits on and is fixedly secured to a shoulder of the body assembly between the flange and cool wall portion.

10. A diffusion pump for connection between a high vacuum chamber and a fore line leading to a fore pump comprising a body assembly including a cool cylindrical wall portion having a longitudinal centrally located axis, a pool of diffusion pump fluid at the bottom of the body assembly, a boiler for heating the fluid to a vapor state, a jet assembly concentric with the axis, a flow path for the vapor from the surface of the pool to the jet assembly, the jet assembly including at least one annular nozzle concentric with the axis for directing the vapor downwardly against the cool wall portion, the cool wall portion condensing the vapor striking it into a liquid that flows downwardly along the cool wall toward the pool, an annular unperforated flange concentric with the axis and at the top of the body assembly for enabling the pump to be sealingly connected to the high vacuum chamber, the cool wall portion and the flange being formed from a single piece of sheet metal, and a flange clamping plate coaxial with and surrounding the flange to clamp the flange against the chamber.

11. The pump of claim 10 wherein said plate has a contact face pressing against one side of an annular ear of the flange, an O-ring adapted to be in sealing engagement with the other side of the annular ear and the chamber.

12. The pump of claim 10 wherein the clamping plate is rotatable relative to the body assembly.

13. A diffusion pump for connection between a high vacuum chamber and a fore line leading to a fore pump comprising a body assembly including a cool cylindrical wall portion having a longitudinal centrally located axis, a pool of diffusion pump fluid at the bottom of the body assembly, a boiler for heating the fluid to a vapor state, a jet assembly concentric with the axis, a flow path for the vapor from the surface of the pool to the jet assembly, each jet assembly including at least one annular nozzle concentric with the axis for directing the vapor downwardly and outwardly against the cool wall portion, the cool wall portion condensing the vapor striking it into a liquid that flows downwardly along the cool wall toward the pool, and annular flange concentric with the axis and at the top of the body assembly for enabling the pump to be sealingly connected to the high vacuum chamber, a floor for confining the bottom of the pool, the body assembly having a wall segment for confining the periphery of the pool, the improvement being that the boiler comprises a cylindrical heating surface centrally located in the pool and extending axially from the bottom of the pool to the surface of the pool, said surface being surrounded by a separator tube having openings close to the bottom of the pool so that liquid at the bottom of the pool enters an annular space between the separator and the heating surface close to the bottom of the pool and rises in the annular space while being heated to vaporization.

14. The pump of claim 13 wherein the body assembly has a downwardly depending annular flange connected to the floor by a rounded corner, the downwardly depending flange being formed by deep drawing the body assembly, the downwardly depending flange being bonded to the heating surface.

15. The pump of claim 14 wherein the heating surface comprises a cylinder having a reamed cylindrical, axial bore, whereby the heating surface is the exterior of a relatively thick wall, and a cylindrical electric heater positioned in the bore and contacting the interior of the thick wall.

16. The pump of claim 15 further comprising a cup surrounding the wall segment and floor so that a space is formed between the inner surface of the cup and the exterior of the wall segment and floor, the cup being bonded to the wall segment and the cylinder forming the heating surface, a solid heat insulator being located in the space.

17. The pump of claim 13 further comprising a solid heat insulator surrounding the floor and wall segment.

18. The pump of claim 13 wherein the wall portion is cooled by a cooling coil wrapped around the exterior of the wall portion, the coil having a non-uniform pitch and the coil is in contact with the hottest parts of the wall portion and cooler parts of the wall portion are not in contact with the coil.

19. The pump of claim 13 further including a flange clamping plate coaxial with and surrounding the flange to clamp the flange against the chamber.

20. The pump of claim 19, said clamping plate having a contact face pressing against one side of an annular ear of the flange, an O-ring adapted to be in sealing engagement with the other side of the annular ring and the chamber.

21. The pump of claim 13 further including a baffle plate positioned between a first stage of the pump and an intersection between the pump to the chamber, said plate being mechanically connected to the cool wall portion through a path having a high thermal conductivity so that the baffle is cool enough to condense vapor of the diffusion pump fluid that impinges on it.

22. The pump of claim 21 wherein the path includes a centrally apertured plate having a periphery that sits on and is fixedly secured to a shoulder of the body assembly between the flange and cool wall portion.

* * * * *